US009243380B2

(12) United States Patent
VanBuskirk

(10) Patent No.: US 9,243,380 B2
(45) Date of Patent: Jan. 26, 2016

(54) REINFORCED ARCH WITH FLOATING FOOTER AND METHOD OF CONSTRUCTING SAME

(71) Applicant: Terratech Consulting Ltd., Salmon Arm (CA)

(72) Inventor: Calvin D. VanBuskirk, Salmon Arm (CA)

(73) Assignee: Terratech Consulting Ltd., Salmon Arm (CA)

( * ) Notice: Subject to any disclaimer, the term of this patent is extended or adjusted under 35 U.S.C. 154(b) by 0 days.

(21) Appl. No.: 13/914,342

(22) Filed: Jun. 10, 2013

(65) Prior Publication Data

US 2014/0363236 A1 Dec. 11, 2014

(51) Int. Cl.
*E02D 29/00* (2006.01)
*E02D 29/045* (2006.01)

(52) U.S. Cl.
CPC ..... *E02D 29/045* (2013.01)

(58) Field of Classification Search
CPC ..... E01D 19/005; E01F 5/005; E02D 29/045
USPC ..... 405/125, 126, 149, 124; 14/26, 77.1, 14/78; 52/86, 169.1, 292
See application file for complete search history.

(56) References Cited

U.S. PATENT DOCUMENTS

| | | | | | |
|---|---|---|---|---|---|
| 391,463 | A | * | 10/1888 | Ellis | 14/24 |
| 832,017 | A | | 9/1906 | Hummel | |
| 1,028,638 | A | | 6/1912 | Thorsby | |
| 1,926,843 | A | | 9/1933 | Fischer | |
| 3,508,406 | A | | 4/1970 | Fisher | |
| 4,010,617 | A | | 3/1977 | Fisher | |
| 4,141,666 | A | | 2/1979 | DeGraff | |
| 4,318,635 | A | | 3/1982 | Gurtner | |
| 4,558,969 | A | * | 12/1985 | FitzSimons | 405/124 |
| 4,605,338 | A | | 8/1986 | Peterson | |
| 4,618,283 | A | | 10/1986 | Hilfiker | |
| 4,650,369 | A | * | 3/1987 | Thomas et al. | 405/126 |
| 4,735,234 | A | * | 4/1988 | Matiere | E02D 29/045 138/100 |
| 5,720,577 | A | | 2/1998 | Sanders | |
| 5,893,187 | A | * | 4/1999 | Fukuoka | 14/74.5 |
| 5,920,938 | A | * | 7/1999 | Elcock et al. | 14/77.1 |
| 6,050,746 | A | | 4/2000 | McCavour | |
| 6,129,484 | A | * | 10/2000 | Chiaves | 405/134 |

(Continued)

FOREIGN PATENT DOCUMENTS

| | | |
|---|---|---|
| CA | 1056169 | 6/1979 |
| CA | 1340179 | 12/1998 |
| CA | 2254595 | 6/1999 |

OTHER PUBLICATIONS

El-Naggar, Mohamed E., et al., "Effect of geotextile reinforcement on soil-steel flexible bridges", Alexandria Engineering Journal, 2003, 42(6):695-705.

*Primary Examiner* — Thomas B Will
*Assistant Examiner* — Katherine Chu
(74) *Attorney, Agent, or Firm* — Oyen Wiggs Green & Mutala LLP

(57) ABSTRACT

A reinforced soil arch having a floating footer is provided. The reinforced soil arch has an archway form, a plurality of layers of reinforcement material and compacted fill associated with the archway form, and a floating footer supporting the archway form. The archway form floats on a compressible squeeze block in the floating footer. Methods of constructing a reinforced soil arch are provided.

23 Claims, 6 Drawing Sheets

(56) References Cited

U.S. PATENT DOCUMENTS

| | | | | |
|---|---|---|---|---|
| 6,854,928 | B2 * | 2/2005 | Lockwood | 405/124 |
| 6,874,974 | B2 | 4/2005 | VanBuskirk | |
| 7,305,798 | B1 * | 12/2007 | Heierli | E02D 29/05 405/125 |
| D566,852 | S | 4/2008 | Gaster | |
| 7,568,860 | B2 * | 8/2009 | Chiaves | 405/134 |
| 7,770,250 | B2 * | 8/2010 | Boresi et al. | 14/24 |
| 8,215,869 | B2 | 7/2012 | VanBuskirk | |
| 8,523,486 | B2 * | 9/2013 | Aston et al. | 405/126 |
| 8,789,337 | B2 * | 7/2014 | Aston et al. | 52/742.1 |
| 2009/0126129 | A1 * | 5/2009 | D'Agostino et al. | 14/26 |
| 2013/0101346 | A1 * | 4/2013 | Novotny | E01F 5/005 404/4 |

* cited by examiner

REINFORCED ARCH WITH FLOATING FOOTER AND METHOD OF CONSTRUCTING SAME

TECHNICAL FIELD

Some embodiments of the present invention pertain to reinforced soil arch structures. Some embodiments of the present invention pertain to reinforced soil arch structures having a yielding footer. Some embodiments of the present invention pertain to methods of making such structures.

BACKGROUND

Geosynthetic reinforced soil arch structures provide an environmentally preferable and/or less expensive alternative to more traditional construction materials used for bridges, culverts, overpasses and the like, e.g. steel structures, reinforced concrete structures, plastic structures and the like. Geosynthetic reinforced soil arches for use in the design of structures such as bridges, overpasses, snowsheds, landslide or rock fall protection structures, or the like are described, for example, in U.S. Pat. Nos. 6,874,974 and 8,215,869 to Van-Buskirk, which are incorporated by reference herein in their entirety. Some such arches have a supporting form (typically but not necessarily an arch form) made from a rigid material such as metal, concrete, reinforced concrete, plastic or reinforced plastic. A plurality of alternating layers of compacted soil and reinforcement made from geosynthetics, plastic, metal, wood and/or the like are associated with the supporting form. Some such arches have an archway form, a combination of alternating and interacting layers of compacted mineral soil and reinforcement material associated with the archway form, and a plurality of shear resisting devices extending from the exterior surface of the archway into the reinforced soil mass. Mineral soil can include clay, silt, sand, gravel, cobbles, boulders, broken rock, or mixtures of any of the foregoing.

U.S. Pat. No. 4,010,617 to Fisher, which is incorporated by reference herein, discloses a composite arch structure comprising an arched liner with compacted fill material or dense soil thereagainst to form a soil arch thereabout. The liner has a foundation comprising yielding footer means.

There remains a need for improved footers for geosynthetic reinforced soil arch structures.

The foregoing examples of the related art and limitations related thereto are intended to be illustrative and not exclusive. Other limitations of the related art will become apparent to those of skill in the art upon a reading of the specification and a study of the drawings.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

One embodiment provides a reinforced soil arch having an archway form, a plurality of alternating layers of compacted fill and reinforcement material associated with the archway form, and a floating footer independent of the archway form. The archway form is supported by the floating footer. The floating footer can comprise a solid base and a squeeze block, with the squeeze block interposing the solid base and the archway form. A load distributing member can interpose the squeeze block and a longitudinal edge of the archway form. The archway form is not coupled to the load distributing member, the squeeze block or the solid base.

One embodiment provides a method of providing a reinforced soil arch having a floating footer. A floating footer is provided along a first edge of the reinforced soil arch. A floating footer is provided along a second edge of the reinforced soil arch. An archway form is positioned on the floating footers on the first and second edges. The archway form is independent of the floating footers. A plurality of alternating layers of compacted fill and reinforcement material associated with the archway form are provided and the archway form is allowed to compress the floating footer.

In addition to the exemplary aspects and embodiments described above, further aspects and embodiments will become apparent by reference to the drawings and by study of the following detailed descriptions.

BRIEF DESCRIPTION OF THE DRAWINGS

Exemplary embodiments are illustrated in referenced figures of the drawings. It is intended that the embodiments and figures disclosed herein are to be considered illustrative rather than restrictive.

DESCRIPTION

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

Figure 1:
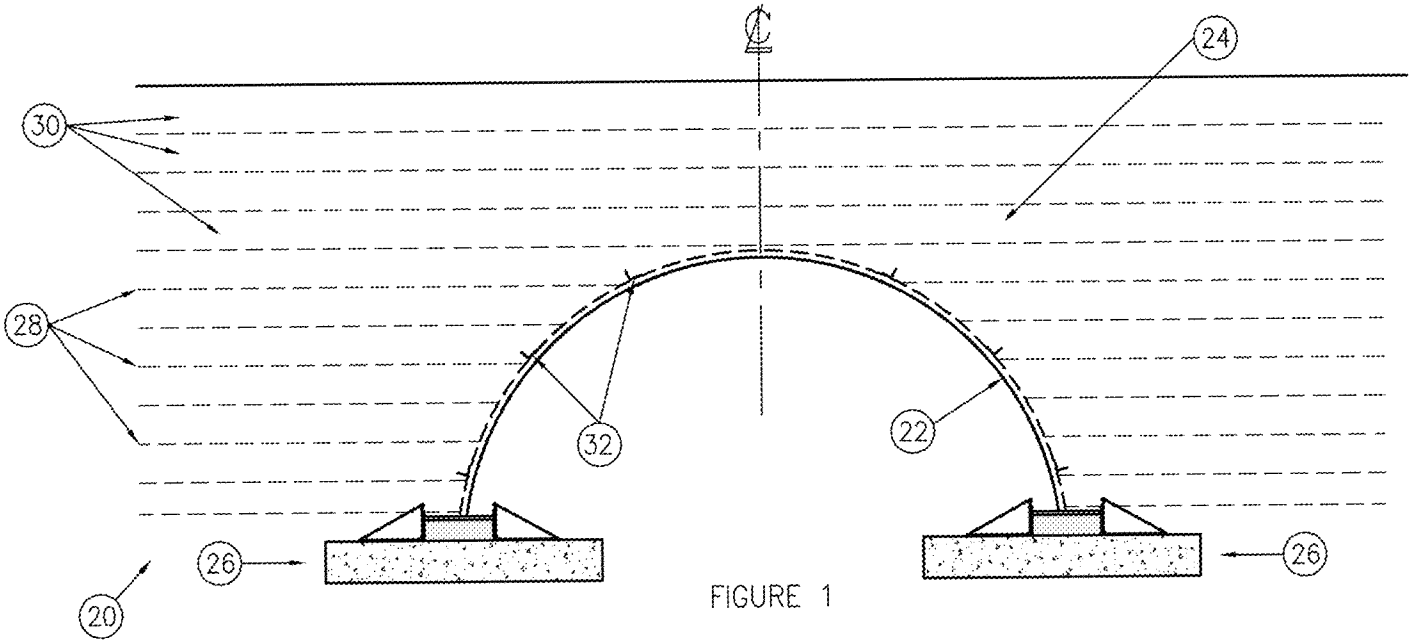
FIG. 1 is a cross-sectional view of a first example embodiment of a reinforced soil arch having a floating footer.

With reference to FIG. 1, a first example embodiment of a reinforced soil arch with a floating footer 20 is illustrated. Reinforced soil arch 20 has an archway form 22, a reinforced soil arch structure 24 and a floating footer, indicated generally at 26.

In the illustrated embodiment of FIG. 1, reinforced soil arch structure 24 is formed from a plurality of layers of reinforcement material 28 and compacted fill 30 overlying and associated with archway form 22. Reinforced soil arch structure 24 has a plurality of shear resisting devices 32 secured to the exterior surface of archway form 22. Shear resisting devices 32 cooperate with proximate portions of the alternating layers of compacted fill 30 and reinforcement material 28 to keep archway form 22 in contact with reinforced soil arch structure 24 by preventing shear and separation between archway form 22 and reinforced soil arch structure 24 (i.e. shear resisting devices 32 ensure that the alternating layers of compacted fill 30 and reinforcement material 28 remain associated with archway form 22). In some embodiments, reinforcement material 28 restrains archway form 22 from moving inwardly (i.e. towards the centre of the opening defined by archway form 22) relative to floating footer 26. In some embodiments, the earth pressures associated with the construction of the reinforced soil arch 24 restrain archway form 22 from moving outwardly (i.e. away from the centre of the opening defined by archway form 22) relative to floating footer 26. In some embodiments, shear resisting devices 32 help reinforced soil arch 24 support archway form 22.

Archway form 22 can be formed of any suitable material, such as metal, plastic, concrete, wood, or a composite of two or more of the foregoing. In one example embodiment, archway form 22 is formed from structural metal plate. Archway form 22 can have any suitable shape, for example a semicircle or shallow semicircle, a reentrant arch, a vertical or horizontal ellipse, a pear shape, a box shape, or a curved overpass or underpass.

Reinforcement material 28 can be constructed from any suitable material including geosynthetics, plastic, metal, wood, or the like. In some embodiments, reinforcement material 28 is woven geotextile.

The layers of compacted fill 30 can be formed from any suitable material. In some embodiments, the layers of compacted fill 30 are formed from mineral soil, for example, clay, silt, sand, gravel, cobbles, boulders, broken rocks, or the like, or mixtures of any of the foregoing. In some embodiments, the layers of compacted fill 30 are made from manufactured materials such as: rubber; plastics; glass; expanded shale, clay or slate; aggregate; or shredded or chipped wood.

Shear resisting devices 32 can be any suitable material. In some embodiments including the illustrated embodiment, shear resisting devices 32 are angle plates attached to the exterior surface of the archway form. The angle plates can be affixed to the archway form in any suitable manner, for example by welding, bolting or the like. In some embodiments, shear resisting devices 32 are affixed to archway form 22 so that shear resisting devices 32 extend generally orthogonally outwardly from archway form 22.

Figure 2:
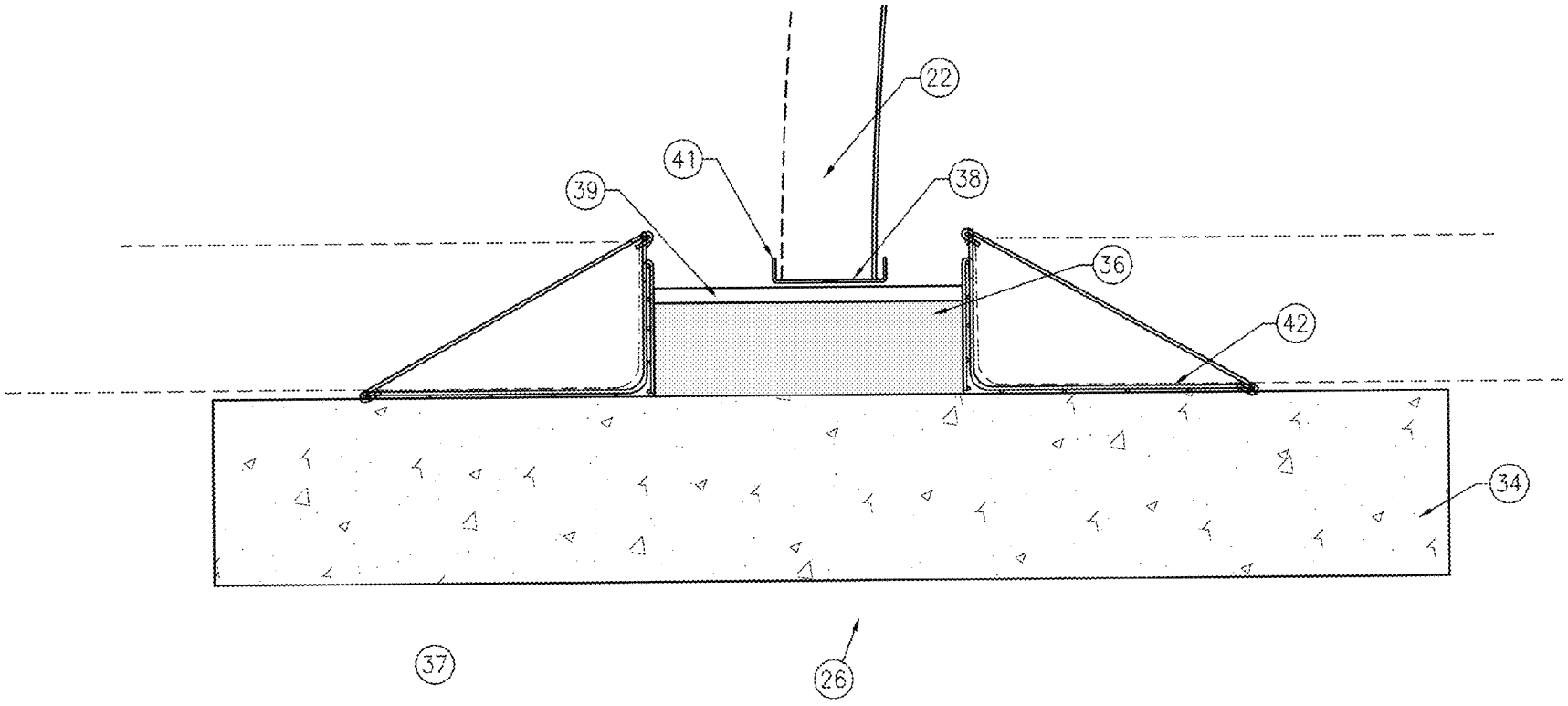
FIG. 2 is a cross-sectional view of an example embodiment of a floating footer.

A floating footer 26 is provided at the base of each edge of archway form 22, and extends longitudinally for the length or for substantially the length of archway form 22. With reference to FIG. 2, the illustrated example embodiment of a floating footer 26 has a solid base 34 and a compressible squeeze block 36. Each longitudinal edge 38 of archway form 22 floats on a squeeze block 36, and squeeze block 36 is supported on solid base 34. Archway form 22 is supported on but independent of squeeze block 36, i.e. archway form 22 is not coupled or otherwise secured to squeeze block 36 or solid base 34.

Figure 6:
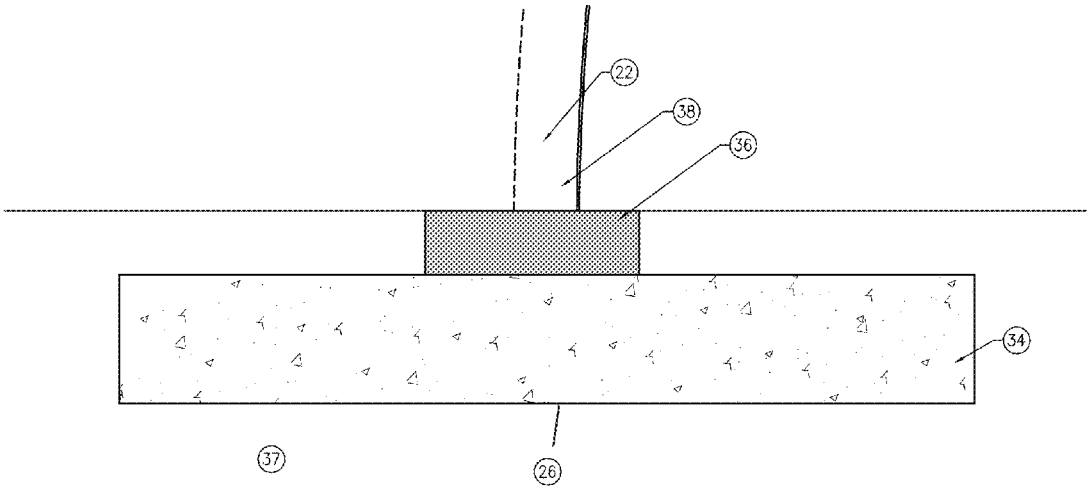
FIG. 6 is a partial cross-sectional view of a fifth example embodiment of a floating footer.

In some embodiments, including the illustrated embodiment, a bearing plate 39 interposes all or a portion of longitudinal edge 38 of archway form 22 and squeeze block 36, so that the downward force applied as archway form 22 settles is applied evenly across all or a portion of the upper surface of squeeze block 36. In some embodiments, bearing plate 39 is omitted or replaced by channel 41, described below. In some embodiments, for example as illustrated in FIG. 6, the archway form is in direct contact with the floating footer. The dimensions of bearing plate 39 can be selected by one skilled in the art based on the characteristics of the soil supporting floating footer 26, solid base 34, and/or squeeze block 36 to provide a desired rate and extent of compression of squeeze block 36. Archway form 22 is not secured to bearing plate 39 or to squeeze block 36, i.e. archway form 22 floats on floating footer 26.

Squeeze block 36 can be formed from any suitable material. In some embodiments, squeeze block 36 is formed from a material having a known compressibility. In some embodiments, squeeze block 36 is formed from expanded polystyrene foam. In some embodiments, squeeze block 36 is formed of wood (including solid wood, logs, wood chips or chunks, shredded wood or the like), soil, sand, plastic, rubber, paper, weakly cemented sand and gravel (engineered concrete), corrugated metal, or liquid- or air-filled bladders. In some embodiments, two or more of the foregoing materials may be used to provide squeeze block 36.

In some embodiments in which the material used to provide squeeze block 36 is loose material (e.g. soil), a trench or other structure may be provided to hold squeeze block 36 in place. For example, in some embodiments, the soil on either side of the location where squeeze block 36 is to be provided is compacted, leaving uncompacted soil disposed within the trench to provide squeeze block 36. In other embodiments, the soil at and adjacent to the location where squeeze block 36 is to be provided is compacted, and then a trench is excavated within the compacted soil and filled with loose soil or other material to provide squeeze block 36. In some other embodiments in which the material used to provide squeeze block 36 is loose, no structure is used to hold squeeze block 36 in place, and the material is dispersed across a sufficiently large area to ensure that the bearing plate 39 or other load distributing member is supported on the material providing squeeze block 36. For example, in embodiments in which bearing plate 39 is approximately 0.5 m wide, a zone of loose soil approximately 10-12 cm deep and 50 cm wide or wider can be spread to provide squeeze block 36.

Without being bound by theory, the squeeze block 36 undergoes deformation, allowing archway form 22 to settle downward at a similar rate to the reinforced soil arch structure 24, thus relieving a significant portion of the load from archway form 22. Bearing plate 39 and/or channel 41 described below (where used) cooperate with squeeze block 36, solid base 34, and the underlying soil 37 to produce sufficient settlement of archway form 22 so that the majority of the dead load of the structure and live loads imposed on the structure are transferred onto the reinforced soil arch 24. By selecting the material used for squeeze block 36 to have desired characteristics of compressibility and dimensions, squeeze block 36 can be designed to undergo a controlled deformation as the load on archway form 22 is increased as layers of reinforcement material 28 and compacted fill 30 are built up over archway form 22. The dimensions of squeeze block 36 are selected based on the engineering properties of the material used for squeeze block 36.

The dimensions of bearing plate 39 can also be selected to control the rate of deformation of squeeze block 36. Selecting a larger bearing plate 39 will cause the downward force on archway form 22 to be distributed across a greater surface area of squeeze block 36, thereby producing a smaller deformation.

Solid base 34 can be formed from any suitable material. In some embodiments, solid base 34 comprises a concrete footing. In some embodiments, solid base 34 comprises a steel reinforced concrete footing. In some embodiments, solid base 34 comprises compacted fill. In some embodiments, solid base 34 comprises native mineral soils. In some embodiments, solid base 34 comprises wood, including solid wood, logs, pressure-treated wood, or the like. In some embodiments in which solid base 34 comprises wood, reinforced soil arch 20 is temporary in nature, since wood may eventually rot, causing additional settlement.

The dimensions of solid base 34 are selected based on factors including the engineering properties of the material selected for solid base 34, the expected load, and the allowable bearing capacity of the underlying soil. In some embodiments, the dimensions of solid base 34, and particularly the width of solid base 34, are selected to be sufficiently large to minimize settlement of solid base 34 relative to the underlying soil. Although solid based 34 has been illustrated as being wider than squeeze block 36, this is not necessary in all embodiments. In some embodiments, solid base 34 has the same width as squeeze block 36.

In some embodiments, a channel 41 interposes squeeze block 36 and the base of each edge of archway form 22 instead of or in addition to bearing plate 39. Channel 41 and bearing plate 39 are examples of load distributing members and act to distribute the force applied by the longitudinal edges 38 of archway form 22 more evenly on the surface of squeeze block 36. The bearing plate 39 or channel 41 cooperate with squeeze block 36, solid base 34, and the underlying soil to provide sufficient settlement of archway form 22 to transfer the majority of the dead load of the structure and the live loads imposed on the structure onto reinforced soil arch structure 24. In some embodiments, channel 41 is a uniform channel. In some embodiments, channel 41 is an unbalanced channel. Archway form 22 is supported by but independent of, i.e. is not coupled directly to, the load distributing member.

Any suitable material can be used to provide the load distributing member, for example metal, concrete, wood or other relatively rigid material.

Figure 3:
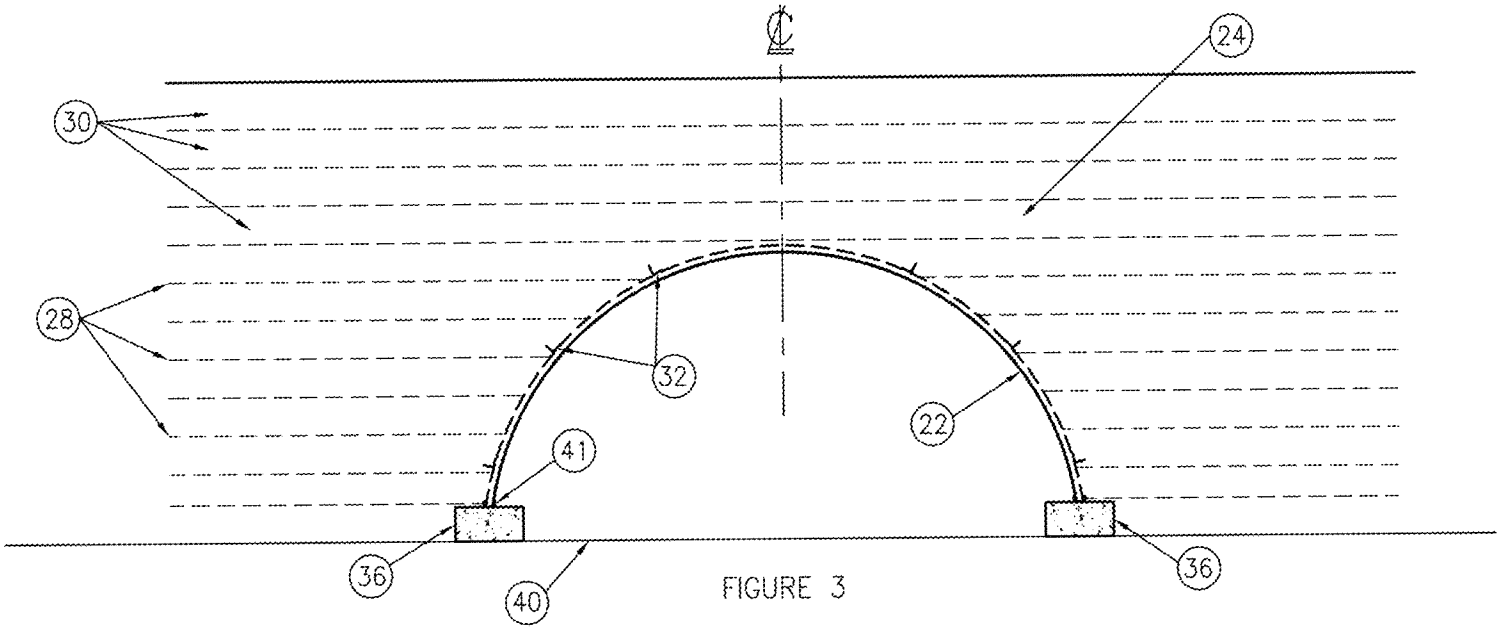
FIG. 3 is a cross-sectional view of a second example embodiment of a reinforced soil arch having a floating footer.

With reference to the example embodiment illustrated in FIG. 3 in which like reference numerals have been used to indicate like parts, in some embodiments, the solid base is provided by native mineral soils. In such embodiments, squeeze block 36 is supported directly on the soil or sub-soil surface underlying archway form 22, indicated by reference numeral 40. In some embodiments, the surface 40 is a rigid surface, for example bedrock. In some embodiments, the surface 40 is compacted mineral soils.

The selection of materials to be used to provide solid base 34 (or which can be used to provide surface 40) and squeeze block 36 can be made by one skilled in the art based on the particular considerations at any given site. Solid base 34 or surface 40 should be selected to be relatively more rigid than squeeze block 36 to allow compression of squeeze block 36 between solid base 34/surface 40 and bearing plate 39/channel 41. In some embodiments, the material used to provide solid base 34 or surface 40 is between 2 times and 1000 times stiffer than the material used to provide squeeze block 36, or any value therebetween, e.g. 10 times stiffer, 100 times stiffer, or the like. The material used to construct squeeze block 36 can be selected and made of an appropriate height to provide the desired level of compression of squeeze block 36 based on the anticipated load to be experienced by archway form 22 and the compressibility of the material used to provide squeeze block 36.

Changing the surface area of channel 41 and/or bearing plate 39 that contacts squeeze block 36 can affect deformation because a smaller deformation will occur if a larger surface area contacts squeeze block 36 (the load will be more evenly distributed across the surface of squeeze block 36, and squeeze block 36 will undergo a correspondingly smaller deformation in the vertical direction). Changing the material used to provide squeeze block 36 will affect deformation because a stiffer material will undergo a smaller level of deformation than a less stiff material.

In some embodiments, the material used to provide squeeze block 36 and the size of channel 41 and/or bearing plate 39 are selected to provide an expected deformation of between about 1% and about 2% of the overall height of reinforced soil arch 20. For example, if reinforced soil arch 20 is 2 meters in height, the material used to provide squeeze block 36 and the size of channel 41 and/or bearing plate 39 are selected to provide an expected deformation of between about 2 to 4 centimeters. For a reinforced soil height of 10 meters, the target deformation range in some embodiments is in the range of 10 to 20 centimeters. Different levels of deformation may be desirable depending on the type of soil present at the site where reinforced soil arch 20 is being erected. It has been found that for typical soil, deformation of approximately 1% of the overall height of the structure is common.

In one example embodiment of a reinforced soil arch having a 12 meter arch with 12 meters of fill, the rigid base is concrete overlying bedrock, the squeeze block is made from expanded polystyrene foam (EPS) and the bearing plate is made from steel. The deformation of the squeeze block is approximately 12 centimeters.

In another example embodiment, the squeeze block is compacted sand having a height of approximately 10 centimeters and the load distributing member is an unbalanced channel. The rigid base is compacted cobbles and boulders and the deformation of the squeeze block is approximately 5 centimeters.

In some embodiments, squeeze block 36 is restrained on solid base 34 so that squeeze block 36 is not displaced when archway form 22 is initially placed during construction on squeeze block 36. In the example embodiment of FIG. 2, squeeze block 36 is restrained against lateral movement by a wire mesh form 42. In other embodiments, geotextile fabric and compacted fill such as compacted mineral soils or manufactured materials are used to secure squeeze block 36. Any other suitable mechanism for restraining squeeze block 36 on solid base 34 during construction could be used in place of wire mesh form 42, for example plastic dowels extending between solid base 34 and squeeze block 36, a trench formed in the top of solid base 34 that is dimensioned to partially receive squeeze block 36 therein, adhesive securing squeeze block 36 to solid base 34, soil piled on either side of squeeze block 36 to secure squeeze block 36, or the like. In some embodiments, the securing of squeeze block 36 is only used as a construction aid and does not influence the as-constructed performance of the structure.

Generally it will be convenient to provide floating footer 26 extending along the full length or substantially the full length of archway form 22. However, floating footer 26 could be provided discontinuously along the length of archway form 22 (e.g. a floating footer 26 extending less than half the length of archway form 22 could be provided at each longitudinal end of archway form 22, so that a middle portion of archway form 22 is not supported on a floating footer, or a further floating footer 26 could be provided to support a middle portion of archway form 22, or the like), so long as floating footer 26 allows archway form 22 to settle a desired amount.

Typically, floating footer 26 will be provided along both edges of archway form 22. However, in some embodiments, floating footer 26 could be provided only along one edge of archway form 22.

Figure 4:
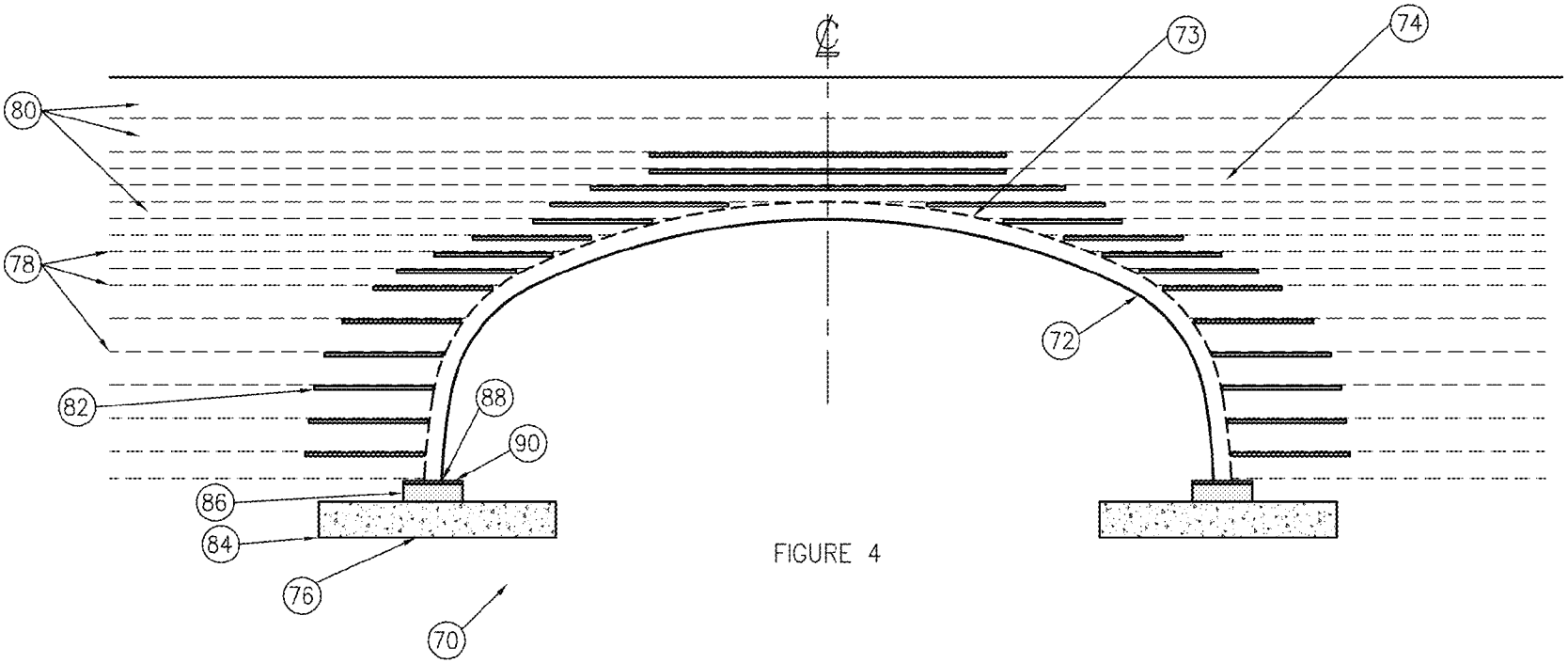
FIG. 4 is a cross-sectional view of a third example embodiment of a reinforced soil arch having a floating footer.

FIG. 4 illustrates an alternative embodiment of a reinforced arch 70 having a floating footer. Reinforced arch 70 has an archway form 72, a reinforced soil arch structure 74, and a floating footer generally indicated by reference numeral 76.

Reinforced soil arch structure 74 has a plurality of layers of reinforcement material 78 between a plurality of layers of compacted fill 80. In the illustrated embodiment, the plurality of layers of reinforcement material 78 and compacted fill 80 are associated with archway form 72 via the interconnection of reinforcement material 78 with an outside surface 73 of archway form 72. In some embodiments, reinforcement material 78 is interconnected with archway form 72 via securement to welded wire mesh 82, bars, or other means secured to the outside surface of archway form 72. Reinforcement material 78 may be connected to archway form 72 in any suitable manner. In some embodiments, the interconnection of reinforcement material 78 with outside surface 73 of archway form 72 restrains archway form 72 against inward movement relative to floating footer 76. In some embodiments, the earth pressures associated with the construction of reinforced soil arch 74 restrains archway form 72 against outward movement relative to floating footer 76.

Reinforcement material 78 and compacted fill 80 can be made from the same materials as reinforcement material 28 and compacted fill 30. Archway form 72 can be made from the same materials and comprise the same variety of shapes as archway form 22.

Floating footer 76 is generally similar in construction to floating footer 26 and can be constructed from the same type of materials used to construct floating footer 26. In the illustrated embodiment, floating footer 76 has a solid base 84, a compressible squeeze block 86, and a bearing plate 90. Compressible squeeze block 86 is supported on solid base 84 and can be supported thereon in any suitable manner as described with reference to compressible squeeze block 36. Bearing plate 90 sits on compressible squeeze block 86, and each longitudinal edge 88 of archway form 72 floats on one of the bearing plates 90. The longitudinal edges 88 are supported on but independent of the bearing plate 90, i.e. the longitudinal edges 88 are not coupled to the bearing plates 90.

Figure 5:
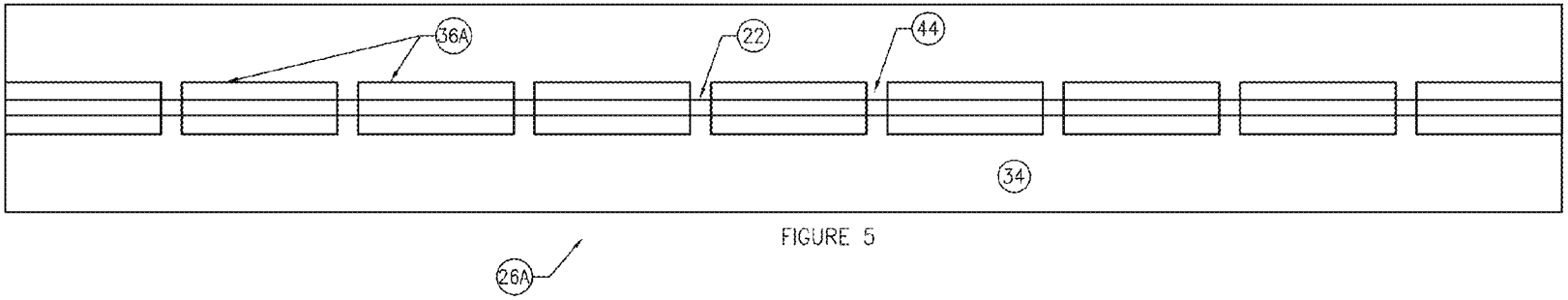
FIG. 5 shows a plan view of a further example embodiment of a floating footer.

In the example embodiment of a floating footer 26A illustrated in FIG. 5, the squeeze block is provided discontinuously. A plurality of portions of squeeze block 36A are supported on a solid base 34 to provide a floating footer to support archway form 22. Each portion of squeeze block 36A is separated from adjacent portions by a gap 44. Squeeze block 86 or other portions of floating footer 26 or 73 could similarly be provided in discontinuous fashion. Although gaps 44 have been illustrated in FIG. 5 as being of relatively uniform size, the discontinuous portions of the floating footer and/or the gaps therebetween could be of different sizes.

While a number of exemplary aspects and embodiments have been discussed above, those of skill in the art will recognize certain modifications, permutations, additions and sub-combinations thereof. For example:

compressible squeeze block 86 could have cross-sectional shapes other than square or rectangular;

while the bearing plate/channel, squeeze block and solid base have been described as being unconnected, in some embodiments these elements could be coupled together for convenience of construction.

It is therefore intended that the following appended claims and claims hereafter introduced are interpreted to include all such modifications, permutations, additions and sub-combinations as are consistent with the broadest interpretation of the disclosure as a whole.

What is claimed is:

1. A reinforced soil arch comprising:

a buried archway form;

a plurality of alternating layers of compacted fill and reinforcement material associated with and overlying the archway form; and a floating footer independent of the archway form, the floating footer comprising a solid base and a compressible squeeze block that undergoes deformation in use, the compressible squeeze block interposing the solid base and the archway form and being positioned vertically beneath the archway form so that the archway form is supported by the floating footer and settles at a similar rate to the alternating layers of compacted fill and reinforcement material to transfer a portion of the load imposed by the alternating layers of compacted fill and reinforcement material away from the archway form.

2. A reinforced soil arch as defined in claim 1, wherein the archway form sits on and is not coupled to the floating footer.

3. A reinforced soil arch as defined in claim 1, wherein the solid base comprises soil or sub-soil underlying the archway form.

4. A reinforced soil arch as defined in claim 1, wherein the floating footer comprises a load distributing member interposing the compressible squeeze block and a longitudinal edge of the archway form.

5. A reinforced soil arch as defined in claim 4, wherein the load distributing member comprises a bearing plate.

6. A reinforced soil arch as defined in claim 4, wherein the load distributing member comprises a channel.

7. A reinforced soil arch as defined in claim 6, wherein the load distributing member comprises a uniform channel or an unbalanced channel.

8. A reinforced soil arch as defined in claim 4, wherein the archway form is not coupled to the load distributing member.

9. A reinforced soil arch as defined in claim 4, wherein the floating footer is discontinuous.

10. A reinforced soil arch as defined in claim 4, wherein the compressible squeeze block comprises wood, soil, plastic, rubber, paper, weakly cemented sand and gravel, corrugated metal, liquid-filled bladders, air-filled bladders, expanded polystyrene foam, or a combination thereof.

11. A reinforced soil arch as defined in claim 4, wherein the compressible squeeze block comprises solid wood, logs, wood chips or chunks, or shredded wood.

12. A reinforced soil arch as defined in claim 4, wherein the solid base comprises concrete, reinforced concrete, compacted fill, native mineral soils, wood, logs, pressure-treated wood, or a combination thereof.

13. A reinforced soil arch as defined in claim 4, wherein the dimensions and compressibility of the compressible squeeze block are selected to provide a deformation of the squeeze block of approximately 1-2% of the height of the reinforced soil arch.

14. A method of providing a reinforced soil arch having a floating footer comprising:

providing a floating footer along a first edge of the reinforced soil arch, the floating footer comprising a solid base and a compressible squeeze block;

providing a floating footer along a second edge of the reinforced soil arch, the floating footer comprising a solid base and a compressible squeeze block, the squeeze block interposing the solid base and the archway form and being positioned vertically beneath the archway form;

positioning an archway form on the floating footers on the first and second edges, the archway form being independent of the floating footers;

providing a plurality of alternating layers of compacted fill and reinforcement material associated with and overlying the archway form to bury the archway form; and allowing the archway form to compress the compressible squeeze blocks of the floating footers to deform the compressible squeeze blocks so that the archway form settles at a similar rate to the alternating layers of compacted fill and reinforcement material to transfer a portion of the load imposed by the alternating layers of compacted fill and reinforcement material away from the archway form.

15. A method as defined in claim 14, wherein providing the floating footer along the first edge of the reinforced soil arch or providing the floating footer along the second edge of the reinforced soil arch comprises providing a discontinuous floating footer.

16. A method as defined in claim 14, wherein positioning an archway form on the floating footers on the first and second edges comprises positioning a longitudinal edge of the archway form on the floating footers without coupling the archway form to the floating footer.

17. A method as defined in claim 14, wherein positioning an archway form on the floating footers on the first and second edges comprises placing a longitudinal edge of the archway form in direct contact with the floating footer.

18. A method as defined in claim 14, wherein providing a floating footer comprises restraining the compressible squeeze block on the solid base.

19. A method as defined in claim 18, wherein restraining the compressible squeeze block on the solid base comprises securing the compressible squeeze block in a wire mesh form mounted to the solid base, inserting dowels through aligned apertures in the solid base and the compressible squeeze block, forming a trench in the top of the solid base that is dimensioned to receive the compressible squeeze block and inserting the compressible squeeze block in the trench, using adhesive to secure the compressible squeeze block to the solid base, piling soil around the compressible squeeze block on the solid base, or using geotextile fabric and compacted fill to secure the compressible squeeze block to the solid base.

20. A method as defined in claim 18, wherein providing a floating footer further comprises positioning a load distributing member on the compressible squeeze block and beneath the edges of the archway form.

21. A method as defined in claim 20, wherein positioning a load distributing member comprises positioning a bearing plate on the compressible squeeze block and beneath the edges of the archway form.

22. A method as defined in claim 20, wherein positioning a load distributing member comprises positioning a channel on the compressible squeeze block and beneath the edges of the archway form.

23. A method as defined in claim 14, wherein allowing the archway form to compress the floating footer comprises allowing the archway form to produce a deformation in the compressible squeeze block of approximately 1-2% of the overall height of the reinforced soil arch.

* * * * *